US008036568B2

(12) United States Patent
Mimura

(10) Patent No.: US 8,036,568 B2
(45) Date of Patent: Oct. 11, 2011

(54) IMAGE FORMING APPARATUS AND TONER CARTRIDGE USED FOR THE SAME

(75) Inventor: Shinya Mimura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 504 days.

(21) Appl. No.: 12/342,381

(22) Filed: Dec. 23, 2008

(65) Prior Publication Data

US 2009/0169241 A1 Jul. 2, 2009

(30) Foreign Application Priority Data

Dec. 28, 2007 (JP) ..... 2007-339893

(51) Int. Cl.
*G03G 15/08* (2006.01)

(52) U.S. Cl. ..... 399/106; 399/102; 399/103; 399/105; 399/258

(58) Field of Classification Search ..... 399/102, 399/103, 105, 106, 258
See application file for complete search history.

(56) References Cited

U.S. PATENT DOCUMENTS

| | | | | |
|---|---|---|---|---|
| 4,998,140 | A * | 3/1991 | Satou et al. | 399/105 |
| 5,177,539 | A | 1/1993 | Tsuji | |
| 5,177,540 | A * | 1/1993 | Honda et al. | 399/106 |
| 5,402,216 | A | 3/1995 | Komaki et al. | |
| 7,332,218 | B1 | 2/2008 | Gilbert | |

FOREIGN PATENT DOCUMENTS

JP 3-98460 10/1991

* cited by examiner

*Primary Examiner* — Ryan Walsh
(74) *Attorney, Agent, or Firm* — Nixon & Vanderhye, PC

(57) ABSTRACT

An image forming apparatus includes an image forming section and a toner cartridge which is loadable into the image forming section. The toner cartridge includes a seal member which is bonded to a peripheral edge of a toner discharging port by an electro-releasing adhesive, of which adhesive force decreases when a current is applied thereto. The image forming section includes a first electrode and a second electrode that contact the peripheral edge of the toner discharging port and the seal member, respectively, when the toner cartridge is loaded into the image forming section. When a current is applied to the electro-releasing adhesive via the first and second electrodes, the adhesive force of the electro-releasing adhesive decreases, whereby the seal member is released from the toner discharging port.

19 Claims, 10 Drawing Sheets

IMAGE FORMING APPARATUS AND TONER CARTRIDGE USED FOR THE SAME

CROSS-REFERENCE TO RELATED APPLICATIONS

This application is related to Japanese patent application No. 2007-339893 filed on Dec. 28, 2007, whose priority is claimed under 35 USC §119, and the disclosure of which is incorporated by reference in its entirety.

BACKGROUND OF THE INVENTION

1. Field of the Invention

The present invention relates to an image forming apparatus and a toner cartridge used for the same, and particularly to an electrophotographic image forming apparatus for forming an image by a toner supplied from a detachable toner cartridge and also to a toner cartridge used for the same.

2. Description of the Background Art

An image forming apparatus for forming an image with the use of electrophotography is frequently and widely used, such as in a copying machine, a printer, and a facsimile, since a high-quality image can be formed with simple operations and the apparatus is easy to maintain and manage.

A general electrophotographic image forming apparatus mainly includes a photoconductor drum for forming an electrostatic latent image, a developing device for developing the electrostatic latent image, a transfer device for transferring a toner image to a recording medium such as a sheet, and a fixing device for fixing the toner image onto the recording medium.

A toner and sheets to be consumed can be added by a user when depleted, but toner, which is composed of extremely light and fine particles, may be scattered in the air and may dirty the user's hand, at the time of adding to the image forming apparatus.

Therefore, in recent years, a method of replacing a toner cartridge per se that stores toner so that the toner particles are not scattered in the air, i.e., a method of unloading an empty toner cartridge from an image forming apparatus and then loading a new toner cartridge into the image forming apparatus, is mostly used.

Generally, in a toner cartridge, a toner discharging port is formed in a portion of the toner cartridge so as to be an outlet for the toner stored in the toner cartridge, and the toner discharging port is tightly sealed by a film seal member until the toner cartridge is loaded into an image forming apparatus.

This prevents the fine toner particles from leaking from the toner cartridge due to vibration during transport.

When the toner cartridge becomes empty and incapable of forming an image, the user unloads the empty toner cartridge from the image forming apparatus and replaces the empty toner cartridge with a new toner cartridge.

At this time, the user is required to load the new toner cartridge into the image forming apparatus after unsealing the new toner cartridge by removing the seal member from the new toner cartridge. As a result, an inexperienced user is confused about removing the seal member, and therefore downtime (inoperable time) of the image forming apparatus increases.

SUMMARY OF THE INVENTION

In view of the foregoing, it is an object of the present invention to provide an image forming apparatus in which a toner cartridge is easily replaced and also to provide a toner cartridge used for the image forming apparatus.

According to the present invention, there is provided an image forming apparatus comprising an image forming section for forming an image, and a toner cartridge for supplying a toner to the image forming section, the toner cartridge being detachably loaded into the image forming section. The toner cartridge includes a toner discharging port for discharging the toner when the toner cartridge is loaded into the image forming section, and a seal member for sealing the toner discharging port until the toner cartridge is loaded into the image forming section. The seal member is bonded to a peripheral edge of the toner discharging port by electro-releasing adhesive, of which adhesive force decreases when a current is applied thereto. The image forming section includes a first electrode and a second electrode that contact the peripheral edge of the toner discharging port and the seal member, respectively, when the toner cartridge is loaded into the image forming section, and a power supply for applying a voltage between the first and second electrodes. When a current is applied to the electro-releasing adhesive via the first and second electrodes, the adhesive force of the electro-releasing adhesive decreases, whereby the seal member is released from the toner discharging port.

According to the image forming apparatus of the present invention, the seal member for sealing the toner discharging port is bonded by the electro-releasing adhesive, of which the adhesive force decreases when a current is applied thereto, and when the toner cartridge is loaded into the image forming apparatus, the first and second electrodes provided in the image forming apparatus contact the peripheral edge of the toner discharging port and the seal member, respectively, and when a current is applied to the electro-releasing adhesive via the first and second electrodes, the adhesive force of the electro-releasing adhesive decreases, whereby the seal member is released from the toner discharging port.

Consequently, it is not necessary to remove in advance the seal member that seals the toner discharging port when replacing the toner cartridge, and as a result, even an inexperienced user can easily replace the toner cartridge, and therefore it is possible to reduce downtime (inoperable time) of the image forming apparatus.

DESCRIPTION OF THE PREFERRED EMBODIMENTS

Figure 1:
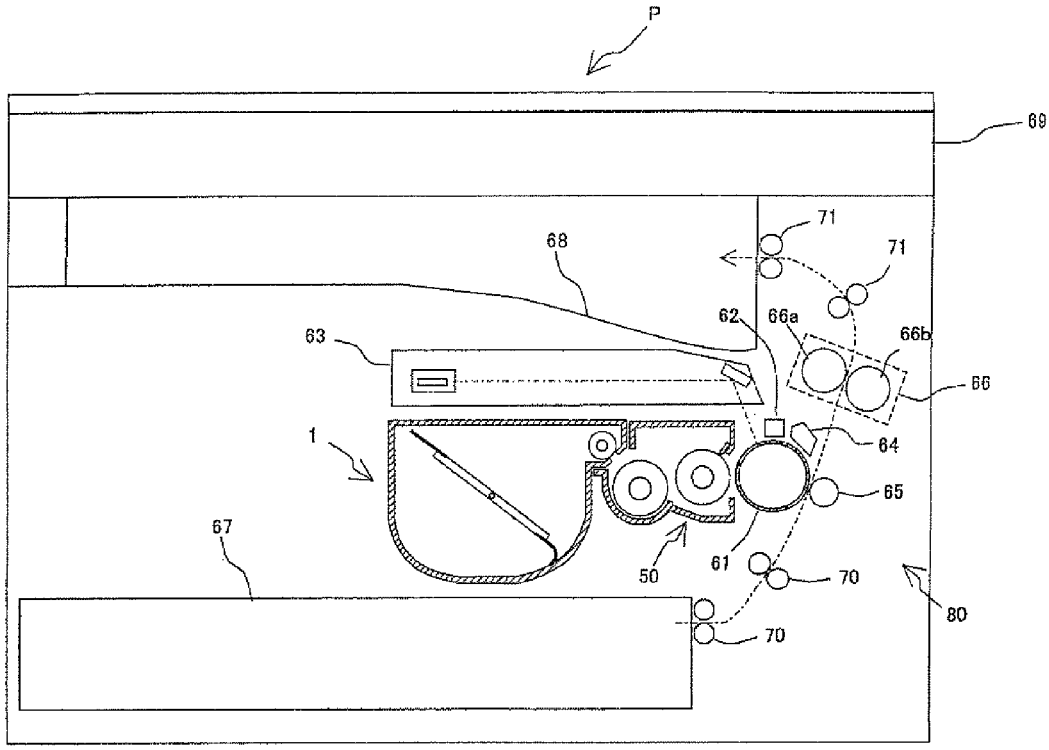
FIG. 1 is a schematic diagram illustrating the overall structure of an image forming apparatus according to an embodiment 1 of the present invention.

An image forming apparatus according to the present invention comprises an image forming section for forming an image, and a toner cartridge for supplying a toner to the image forming section, the toner cartridge being detachably loaded into the image forming section. The toner cartridge includes a toner discharging port for discharging the toner when the toner cartridge is loaded into the image forming section, and a seal member for sealing the toner discharging port until the toner cartridge is loaded into the image forming section. The seal member is bonded to a peripheral edge of the toner discharging port by electro-releasing adhesive, of which adhesive force decreases when a current is applied thereto. The image forming section includes a first electrode and a second electrode that contact the peripheral edge of the toner discharging port and the seal member, respectively, when the toner cartridge is loaded into the image forming section, and a power supply for applying a voltage between the first and second electrodes. When a current is applied to the electro-releasing adhesive via the first and second electrodes, the adhesive force of the electro-releasing adhesive decreases, whereby the seal member is released from the toner discharging port.

In the image forming apparatus of the present invention, the image forming section refers to an image forming mechanism in general for forming an image on a recording medium by electrophotography using a photoconductor and toner.

The toner cartridge refers to a container, detachably loaded into the image forming section, for storing the toner so as to supply the toner to the image forming section. Further, the toner discharging port refers to a discharging port, formed in a portion of the toner cartridge, for allowing the toner to be discharged when the toner cartridge is loaded into the image forming section.

The seal member is a member for sealing the toner discharging port until the toner cartridge is loaded into the image forming section.

The electro-releasing adhesive refers to adhesive that includes a composition in which a bond release can be electrochemically caused, such that a bond release reaction is caused when a current is applied to the adhesive, whereby adhesive force decreases at the joined surface (interface) of the adhesive and an adherend.

As such an electro-releasing adhesive, for example, a composition which has a matrix function and an electrolytic function and in which a bond release can be electrochemically caused, such that the matrix function realizes an adhesive bond to a substrate, that the electrolytic function provides the composition with sufficient ion conductivity and assists a Faradaic reaction at the interface of the composition and an electrically conductive surface contacting to the composition, and that the adhesive bond is weakened at the interface when a potential is applied across the interface, is known (see, for example, Japanese Unexamined Patent Publication No. 2003-504504).

In the above composition, the "matrix function" is defined as a capability to join a substance or a mixture of substances to a substrate by a mechanical bond or a chemical bond and thus to be attached to the substrate by the characteristics of this bond. Further, the "electrolytic function" is defined as a capability of a substance to conduct an ion, i.e., an anion, a cation, or both. Furthermore, the "Faradaic reaction" is defined as an electrochemical reaction where a substance is oxidized or reduced.

Applying a current to the electro-releasing adhesive via the first and second electrodes refers, in other words, to applying a current to the first and second electrodes via the electro-releasing adhesive.

In the inventive image forming apparatus, it is favorable that the toner cartridge includes a release mechanism for assisting the release of the seal member when the adhesive force of the electro-releasing adhesive has been decreased by the application of the current.

With this arrangement, physical force may be applied to the seal member, of which the adhesive force to the peripheral edge of the toner discharging port has been decreased, whereby the seal member can be forcibly peeled. In this case, since the adhesive force of the seal member to the peripheral edge of the toner discharging port has been decreased by the application of the current to the electro-releasing adhesive, the seal member is completely and certainly peeled from the toner discharging port without applying excessive force to the toner cartridge or the seal member.

In the above-described arrangement where the toner cartridge includes the release mechanism, the seal member may be a flexible film for sealing the toner discharging port from the inside, the toner cartridge may include a toner discharging roller for discharging the toner, and the toner discharging roller may function as the release mechanism for assisting the release of the seal member by rotating, elastically contacting the seal member from the inside of the toner cartridge.

With this arrangement, since the toner discharging roller for allowing the toner to be discharged functions as the release mechanism for assisting the release of the seal member from the toner discharging port, it is not necessary to separately provide a mechanism for assisting the release of the seal member.

Consequently, it is possible to avoid high costs due to a complicated structure of the release mechanism.

In the above-described arrangement where the toner cartridge includes the release mechanism, the seal member may be a flexible film for sealing the toner discharging port from the inside, the toner cartridge may include an agitating member for agitating the toner, and the agitating member may function as the release mechanism for assisting the release of the seal member by being connected to one end of the seal member in advance and pulling the seal member.

With this arrangement, since the agitating member for agitating the toner functions as the release mechanism for assisting the release of the seal member from the toner discharging port, it is not necessary to separately provide a mechanism for assisting the release of the seal member.

Consequently, it is possible to avoid high costs due to a complicated structure of the release mechanism. Further, since simply the one end of the seal member is connected to the agitating member in advance, this structure is favorable in view of the guarantee of a proper and certain operation of the release mechanism.

In the inventive image forming apparatus, the power supply may be a DC power supply, the electro-releasing adhesive may have a character that, when the current is applied thereto, a bond release occurs at an interface of the electro-releasing adhesive and an adherend electrically connected to an anode, and the first electrode may be an anode contacting the peripheral edge of the toner discharging port and the second electrode may be a cathode contacting the seal member.

With this arrangement, since only selectively at the interface of the electro-releasing adhesive and the peripheral edge of the toner discharging port, the bond release occurs, i.e., the adhesive force decreases, the electro-releasing adhesive is released from the interface, remaining attached to the seal member. Consequently, the electro-releasing adhesive does not remain on the peripheral edge of the toner discharging port after the seal member is peeled, and thus it is possible to prevent the electro-releasing adhesive from being mixed with the toner.

Additionally, since the electro-releasing adhesive does not remain on the peripheral edge of the toner discharging port, it is also possible to prevent the toner solidified on the peripheral edge of the toner discharging port from blocking the toner discharging port and disturbing the supply of toner.

In the inventive image forming apparatus, it is favorable that the peripheral edge of the toner discharging port and the seal member each have electrical conductivity so that a current is applicable to the electro-releasing adhesive via the first and second electrodes when the toner cartridge is loaded into the image forming section.

The reason is that in view of safety in a current application process, damage prevention of the toner cartridge, and the like, it is favorable that the voltage applied between the first and second electrodes is as low as possible and that the application time is as short as possible.

With this arrangement, since the peripheral edge of the toner discharging port and the seal member each have electrical conductivity, the voltage applied between the first and second electrodes to decrease the adhesive force of the electro-releasing adhesive can be made lower and the application time can also be made shorter than when neither the peripheral edge of the toner discharging port nor the seal member have electrical conductivity (i.e., when specific volume resistance is very high).

In the above-described arrangement where the peripheral edge of the toner discharging port and the seal member each have electrical conductivity, the toner cartridge may be formed so that at least the peripheral edge of the toner discharging port is molded of an electrically conductive resin material obtained by dispersion-mixing a resin material with an electrically conductive material.

With this arrangement, since the toner discharging port is made of the resin material, it is possible to design the toner discharging port with less constraint and more freedom than, for example, when the peripheral edge of the toner discharging port is formed by a metallic material.

Needless to say, the whole of the toner cartridge, including the peripheral edge of the toner discharging port, may be molded of the above-described electrically conductive resin material, or only the toner discharging port may be selectively molded of the electrically conductive resin material.

In the above-described arrangement where at least the peripheral edge of the toner discharging port is molded of the electrically conductive resin material obtained by dispersion-mixing the resin material with the electrically conductive material, the electrically conductive material may be carbon black.

The carbon black is suitable as the electrically conductive material added to the resin material, since, added in even small amounts, the carbon black can decrease the resistance of the resin material and does not decrease the strength of the molded material.

In the above-described arrangement where the peripheral edge of the toner discharging port and the seal member each have electrical conductivity, the toner cartridge may include a metal plate for covering the peripheral edge of the toner discharging port.

With this arrangement, since electrical conductivity is provided to the peripheral edge of the toner discharging port by the metal plate that covers the toner discharging port, the electrical resistance of the toner discharging port extremely decreases, and thus it is possible to sufficiently apply a current to even a small contact point between the first electrode and the peripheral edge of the toner discharging port.

Consequently, it is possible to design the layout of the first electrode and the peripheral edge of the toner discharging port with a margin, and therefore it is favorable in view of limitation of space.

In the above-described arrangement where the peripheral edge of the toner discharging port and the seal member each have electrical conductivity, the seal member may be formed by laminating a metal sheet or an electrically conductive resin layer on a base sheet.

With this arrangement, since electrical conductivity is provided to the seal member by the metal sheet or the electrically conductive resin layer, the electrical resistance of the seal member extremely decreases, and thus it is possible to sufficiently apply a current to even a small contact point between the second electrode and the seal member.

Consequently, it is possible to design the layout of the second electrode with a margin, and therefore it is favorable in view of limitation of space.

Note that the seal member may be formed only of the metal sheet or the electrically conductive resin layer, or may be formed by laminating the metal sheet or the electrically conductive resin layer on a flexible resin base sheet.

When the seal member is formed by laminating the metal sheet or the electrically conductive resin layer on the flexible resin base sheet, needless to say, the metal sheet or the electrically conductive resin layer is laminated on the side contacting the electro-releasing adhesive.

According to another aspect of the present invention, there is provided a toner cartridge comprising a container body for storing a toner, a toner discharging port for discharging the toner, the toner discharging port being formed in a portion of the container body, and a seal member for sealing the toner discharging port, the seal member being bonded to a peripheral edge of the toner discharging port by electro-releasing adhesive, of which adhesive force decreases when a current is applied thereto.

According to the toner cartridge of the present invention, since the seal member for sealing the toner discharging port is bonded to the peripheral edge of the toner discharging port by the electro-releasing adhesive, of which the adhesive force decreases when a current is applied thereto, if a current is applied to the electro-releasing adhesive when the toner cartridge is loaded into the image forming apparatus, the adhesive force of the electro-releasing adhesive decreases, whereby the seal member is released from the toner discharging port.

Consequently, it is not necessary to remove in advance the seal member that seals the toner discharging port when replacing the toner cartridge, and as a result, even an inexperienced user can easily replace the toner cartridge, and therefore it is possible to reduce downtime (inoperable time) of the image forming apparatus.

The toner cartridge of the present invention may further include a release mechanism for assisting a release of the seal member when the adhesive force of the electro-releasing adhesive has been decreased by the application of the current.

The operation and effect of this arrangement are the same as those of the image forming apparatus of the present invention described above.

In the above-described arrangement where the toner cartridge further includes the release mechanism, the seal member may be a flexible film for sealing the toner discharging port from the inside of the container body, the container body may include a toner discharging roller for discharging the toner, and the toner discharging roller may function as the release mechanism for assisting a release of the seal member by rotating, elastically contacting the seal member from the inside of the container body.

The operation and effect of this arrangement are the same as those of the image forming apparatus of the present invention described above.

In the above-described arrangement where the toner cartridge further includes the release mechanism, the seal member may be a flexible film for sealing the toner discharging port from the inside of the container body, the container body may include an agitating member for agitating the toner, and the agitating member may function as the release mechanism for assisting a release of the seal member by being connected to one end of the seal member in advance and pulling the seal member.

The operation and effect of this arrangement are the same as those of the image forming apparatus of the present invention described above.

In the toner cartridge of the present invention, the peripheral edge of the toner discharging port and the seal member may each have electrical conductivity.

The operation and effect of this arrangement are the same as those of the image forming apparatus of the present invention described above.

In the above-described arrangement where the peripheral edge of the toner discharging port and the seal member each have electrical conductivity, the container body may be formed in such a manner that at least the peripheral edge of the toner discharging port is molded of an electrically conductive resin material obtained by dispersion-mixing a resin material with an electrically conductive material.

The operation and effect of this arrangement are the same as those of the image forming apparatus of the present invention described above.

In the above-described arrangement where at least the peripheral edge of the toner discharging port is molded of the electrically conductive resin material obtained by dispersion-mixing the resin material with the electrically conductive material, the electrically conductive material may be carbon black.

The operation and effect of this arrangement are the same as those of the image forming apparatus of the present invention described above.

In the above-described arrangement where the peripheral edge of the toner discharging port and the seal member each have electrical conductivity, the container body may include a metal plate for covering the peripheral edge of the toner discharging port.

The operation and effect of this arrangement are the same as those of the image forming apparatus of the present invention described above.

In the above-described arrangement where the peripheral edge of the toner discharging port and the seal member each have electrical conductivity, the seal member may be formed by laminating a metal sheet or an electrically conductive resin layer on a base sheet.

The operation and effect of this arrangement are the same as those of the image forming apparatus of the present invention described above.

With reference to the drawings, an image forming apparatus according to each embodiment of the present invention will be described in detail below. Note that common members among the embodiments described below will be denoted by the same numerals when described.

Embodiment 1

Overall Structure and Operation of Image Forming Apparatus

Figure 2:
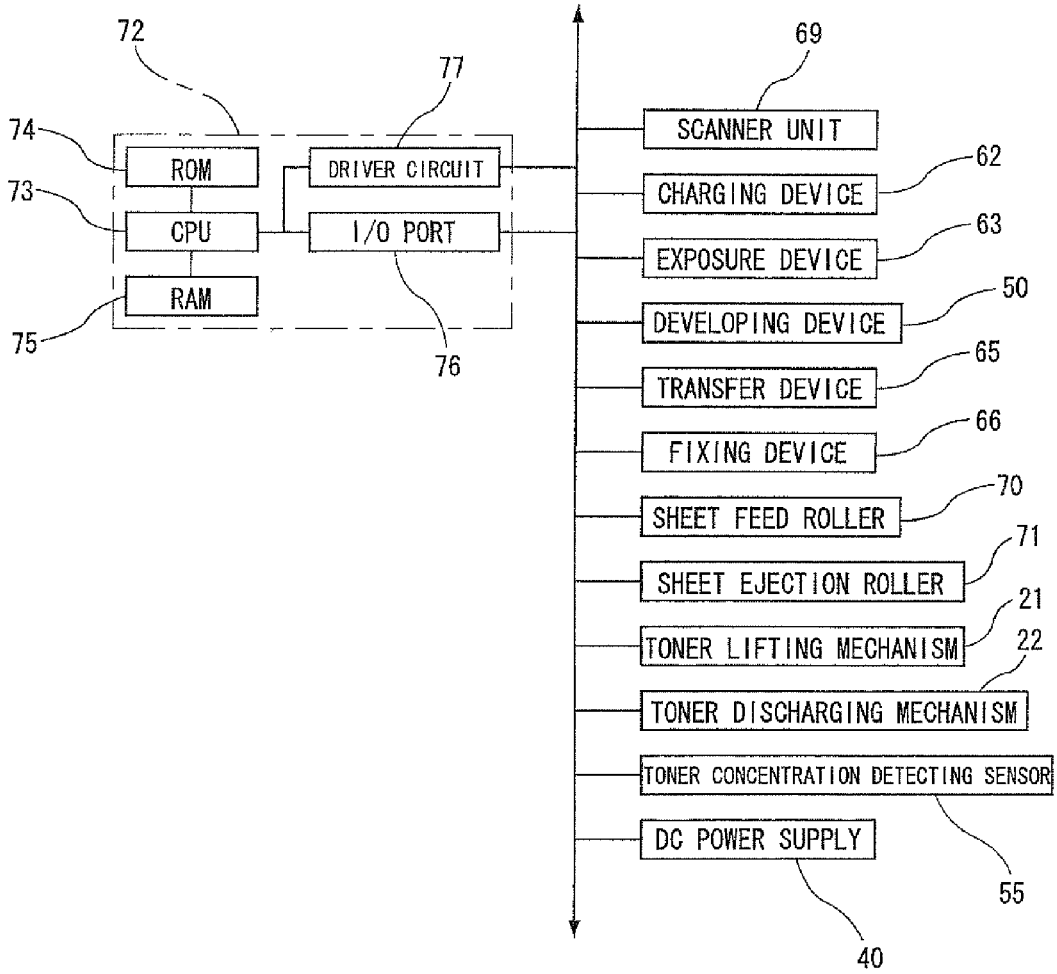
FIG. 2 is a block diagram showing the structure of a control section for controlling the image forming apparatus shown in FIG. 1.

FIG. 1 is a schematic diagram illustrating the overall structure of an image forming apparatus according to the present embodiment. FIG. 2 is a block diagram showing the structure of a control section for controlling the image forming apparatus shown in FIG. 1.

As shown in FIG. 1, an image forming apparatus P according to the present embodiment includes an image forming section 80 composed of a toner cartridge 1, a developing device 50, a photoconductor drum 61, a charging device 62, an exposure device 63, a cleaning device 64, a transfer device 65, a fixing device 66, a sheet cassette 67, a sheet receiving tray 68, and a scanner unit 69.

The photoconductor drum 61 is a roller member, which is provided rotationally drivable in the casing of the image forming apparatus P and on the surface of which an electrostatic latent image corresponding to an image to be formed is formed when the surface is charged to a uniform potential by the charging device 62 and selectively exposed by the exposure device 63.

The electrostatic latent image formed on the surface of the photoconductor drum 61 is made visible by toner supplied from the developing device 50, and is transferred onto a recording medium at the portion opposed to the fixing device 66.

The unfixed toner image transferred onto the recording medium melts and is fixed onto the recording medium by being heated when passing through the fixing device 66. The recording medium having passed through the fixing device 66 is fed by sheet ejection rollers 71 and ejected to the sheet receiving tray 68.

Each element of the image forming section 80 will be described in further detail below.

The photoconductor drum 61 is a roller member formed by laminating a photoconductive layer on the surface of an electrically conductive substrate (not shown). As the electrically conductive substrate, a hollow cylindrical electrically conductive substrate, a solid cylindrical electrically conductive substrate, or a sheeted electrically conductive substrate may be used. The hollow cylindrical electrically conductive substrate is most favorable.

The photoconductive layer may be an organic photoconductive layer, an inorganic photoconductive layer, or the like.

The organic photoconductive layer may be a multi-layer photoconductor including a charge-generating layer which is a resin layer containing a charge-generating material, and also including a charge-transporting layer which is a resin layer containing a charge-transporting material, or a single-layer photoconductor which is one resin layer containing both a charge-generating material and a charge-transporting material, or the like.

The inorganic photoconductive layer may be a film containing one or more of zinc oxide, selenium, amorphous silicon, and the like.

In the photoconductor drum 61, a base film may be provided between the electrically conductive substrate and the photoconductive layer, and a surface film for surface protection (a protection film) may be provided on the surface of the photoconductive layer.

In the present embodiment, the charging device 62 is a charging device shaped like a saw blade for corona-discharging to the photoconductor drum 61. To the charging device 62, a power supply (not shown) for applying a voltage is connected. The charging device 62, having received a voltage applied by the power supply, charges the surface of the photoconductor drum 61 with a predetermined polarity and to a predetermined potential.

However, the charging device 62 is not limited to the saw blade like charging device, and for example, a charger-type charging device, a charging brush-type charging device, a roller-type charging device, or a charging device using a contact method such as a magnetic brush may be used as the charging device 62.

The exposure device 63 receives image data regarding a document read by the scanner unit 69 or image data transmitted from an external device, and causes an optical signal corresponding to the received image data to illuminate the charged surface of the photoconductor drum 61. Consequently, an electrostatic latent image corresponding to the image data is formed on the surface of the photoconductor drum 61. As the exposure device 63, a laser scanning device including a light source may be used.

The laser scanning device may be, for example, a device into which a light source, a polygon mirror, an fθ lens, and a reflective mirror are incorporated. As the light source, for example, a semiconductor laser, an LED array, or an electroluminescence (EL) device may be used.

The developing device 50 prepares two-component developer by agitating and mixing toner which is fine resin powder supplied from the toner cartridge 1 and carrier made of iron powder and the like, in a developing tank 51 with an agitating roller 52, and supplies the prepared two-component developer to the surface of the photoconductor drum 61, thereby making the electrostatic latent image visible by the toner.

The transfer device 65 is a roller member, provided rotationally drivable in the casing of the image forming apparatus P and positioned to contact the surface of the photoconductor drum 61 through the recording medium in a pressing manner. As the transfer device 65, for example, a roller member formed by laminating an electrically conductive elastic layer on the surface of a core, 8 to 10 mm in diameter, may be used.

As a metallic material forming the core, for example, stainless steel or aluminum may be used. As the electrically conductive elastic layer, a rubber material obtained by mixing a rubber material such as ethylene-propylene-diene rubber (EPDM), foamed EPDM, or foamed urethane, with an electrically conductive material such as carbon black, may be used.

In synchronization with the feeding of the visible toner image by the rotation of the photoconductor drum 61 to the pressed contact section (a transfer nip section) of the photoconductor drum 61 and the transfer device 65, the recording medium is supplied sheet by sheet from the sheet cassette 67 via a plurality of sheet feed rollers 70.

The recording medium passes through the transfer nip section, whereby the toner image made visible on the surface of the photoconductor drum 61 is transferred onto the recording medium. To the transfer device 65, a power supply (not shown) is connected so that, when the toner image is transferred onto the recording medium, a voltage of the opposite polarity to the charge polarity of the toner consisting of the toner image is applied to the transfer device 65. Consequently, the toner image is smoothly transferred onto the recording medium.

The cleaning device 64 includes a cleaning blade and a toner reservoir (neither shown). The cleaning blade is a rectangular elastic plate member, extending parallel to the longitudinal direction of the photoconductor drum 61, and is attached in such a manner that one of the long sides, opposite to each other, of the cleaning blade abuts the surface of the photoconductor drum 61 and the other is along the opening of the toner reservoir. The cleaning blade removes toner, paper dust, and the like that remain on the surface of the photoconductor drum 61 after the toner image is transferred onto the recording medium.

The toner reservoir is a container member having internal space, introduces the toner removed by the cleaning blade into the container member through the opening, and temporarily stores the introduced toner.

Thus, the surface of the photoconductor drum 61 after the toner image is transferred is cleaned by the cleaning device 64.

The fixing device 66 includes a fixing roller **66*a* and a pressure roller 66*b*. The fixing roller 66*a*** is a roller member, provided rotationally drivable in the casing of the image forming apparatus P.

The fixing roller **66*a*** includes a heating member (not shown) therein, thereby heating and melting the toner consisting of the unfixed toner image held by the recording medium fed from the transfer nip section, and fixing the melted toner onto the recording medium.

As the fixing roller **66*a***, for example, a roller member formed by covering a core with an elastic layer may be used. The core is made of, for example, a metallic material such as iron, stainless steel, or aluminum. The elastic layer is made of, for example, an elastic material such as silicone rubber or fluororubber. The heating member generates heat due to a voltage applied by a power supply (not shown), and for example, a halogen lamp or an infrared lamp may be used as the heating member.

The pressure roller **66*b* is a roller member, provided rotationally drivable in the casing of the image forming apparatus P and positioned to contact the fixing roller 66*a* in a pressing manner by a pressure member (not shown), and rotates in accordance with the rotation of the fixing roller 66*a*. The pressed contact section of the fixing roller 66*a* and the pressure roller 66*b*** is a fixing nip section.

When the fixing roller **66*a* heat-fixes the toner image onto the recording medium, the pressure roller 66*b* facilitates the fixing of the toner image onto the recording medium by pressing the melted toner against the recording medium. As the pressure roller 66*b*, a roller member having the same structure as that of the fixing roller 66***a* may be used, and a heating member may also be provided therein. As the heating member, a heating member similar to that provided in the fixing roller 66*a* may be used.

The recording medium, onto which the toner image has been fixed when passing through the fixing nip section of the fixing device 66, is ejected to the sheet receiving tray 68 via a plurality of the sheet ejection rollers 71.

The sheet cassette 67 is a tray for storing the recording medium such as plain paper, coated paper, color copy paper, or OHP film. At the uppermost stream side of a sheet feed path, a pick-up roller and a feeding roller (neither shown) are provided such that in synchronization with the feeding of the toner image formed on the surface of the photoconductor drum 61 to the transfer nip section, the recording medium is supplied sheet by sheet from the sheet cassette 67 to the transfer nip section by the pick-up roller and the feeding roller.

The scanner unit 69 includes a document setting tray, a reversing automatic document feeder (RADF), and a document reading device (not shown).

The reversing automatic document feeder feeds a document placed in the document setting tray to a document placement platform of the document reading device.

The document reading device includes the document placement platform, a document scanning device, a reflective member, an optical lens, a charge-coupled device (hereinafter referred to as "CCD") line sensor, and the like.

The document placement platform is a glass plate member on which the document is placed so as to read the image of the document. The document scanning device is a unit composed of a light source and a first reflective mirror (neither shown), and is capable of moving back and forth at a constant speed V along and parallel to the bottom surface of the document placement platform. The reflective member is a unit composed of a second reflective mirror and a third reflective mirror (neither shown), and is capable of moving back and forth at a speed of V/2, following the back and forth movement of the document scanning device. The optical lens forms, on the CCD line sensor, the image of the document that is reflected from the reflective member.

In the case of a moving document reading method where the reversing automatic document feeder is used to automatically feed the document to the document placement platform and read the image of the document: while the document scanning device and the reflective member remain stopped at their own home positions, the document scanning device illuminates the document passing through the document placement platform, the reflective member reflects a reflected light image from the document to the optical lens, and the optical lens forms the image on the CCD line sensor, whereby the document reading device reads the image of the document.

On the other hand, in the case of a stationary document reading method where a user places the document on the document placement platform and causes the image of the document to be read: the document scanning device illuminates the document placed on the document placement platform while moving at the constant speed V along the bottom surface of the document placement platform, the reflective member reflects a reflected light image to the optical lens while moving at the speed of V/2 following the movement of the document scanning device, and the optical lens forms the image on the CCD line sensor, whereby the document reading device reads the image of the document.

The CCD line sensor includes a CCD circuit (not shown) for photoelectric-converting the reflected light image formed by the optical lens into an electrical signal, and outputs the resultant electrical signal, which is image data, to an image processing section (not shown), provided in a control section 72 (see FIG. 2). The image processing section converts the image data received from the document reading device or an external device such as a personal computer into an electrical signal, and outputs the resultant electrical signal to the exposure device 63.

As shown in FIG. 2, the control section 72 is a microcomputer including a CPU 73 for performing arithmetic operations, a ROM 74 having stored therein a control program executed by the CPU 73, a RAM 75 for providing the CPU 73 with a work area, an I/O port 76 for inputting and outputting a control signal to and from various sensors of the image forming section 80 under the control of the CPU 73, a driver circuit 77 for driving various driven sections of the image forming section 80 under the control of the CPU 73, and the like. The control section 72 controls the image forming apparatus P, including the image forming section 80, in an integrated manner.

Structures of Developing Device and Toner Cartridge

Figure 3:
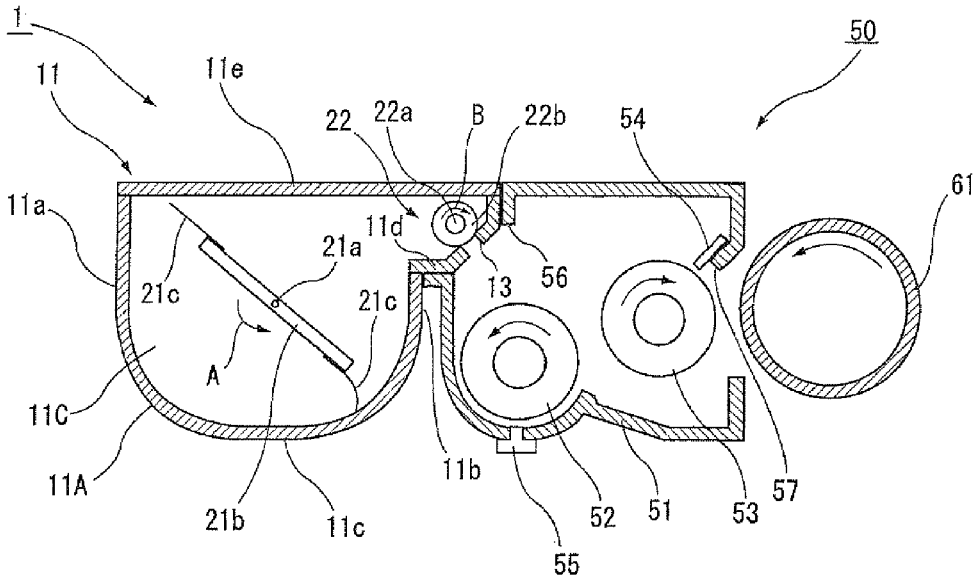
FIG. 3 is an enlarged view of the principal part of FIG. 1, showing a toner cartridge and a photoconductor drum that are located in proximity to a developing device.
Figure 4:
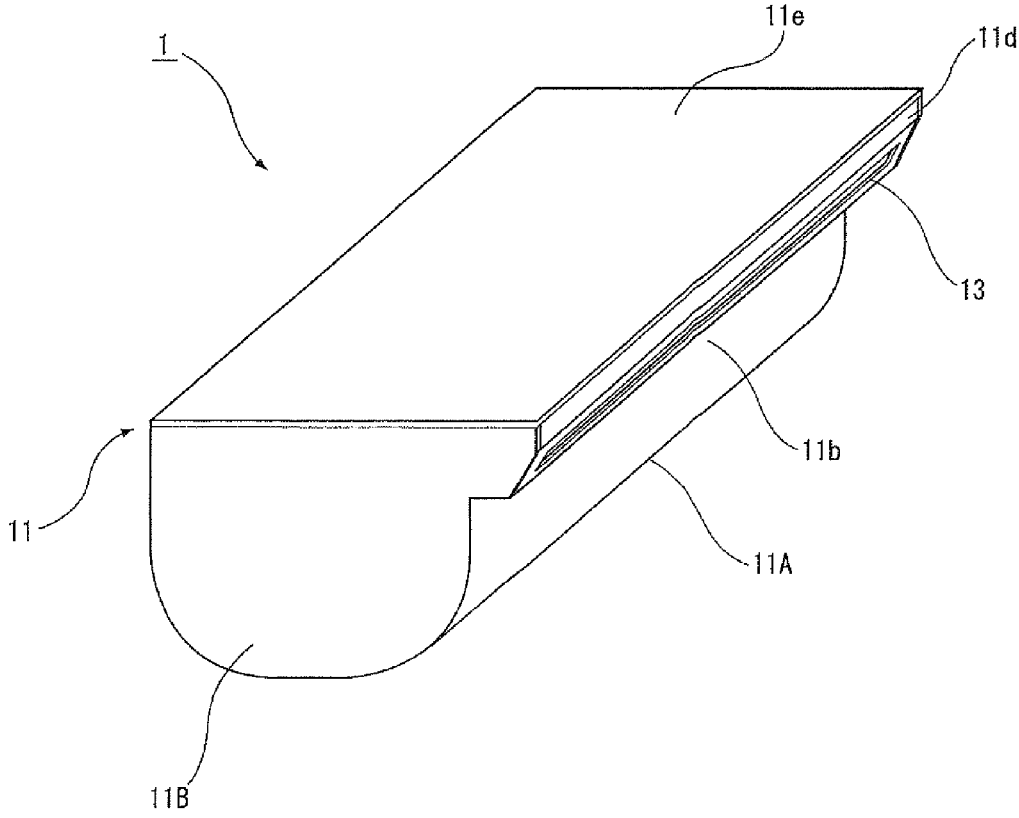
FIG. 4 is a perspective view showing the toner cartridge of FIG. 3 alone.

With reference to FIGS. 3 through 9, the structures of the developing device 50 and the toner cartridge 1 will be described in further detail. FIG. 3 is an enlarged view of the principal part of FIG. 1, showing the toner cartridge 1 and the photoconductor drum 61 that are located in proximity to the developing device 50. FIG. 4 is a perspective view showing the toner cartridge 1 alone.

As shown in FIG. 3, the developing device 50 includes the developing tank 51, the agitating roller 52, a developing roller 53, a restrictive member 54, and a toner concentration detecting sensor 55.

The developing tank 51 is a cylindrical container having internal space, rotatably and pivotally supports the agitating roller 52 and the developing roller 53, and stores two-component developer (not shown) composed of toner and carrier.

The developing tank 51 has a first opening 56, communicated with a toner discharging port 13 in overlap with a protruding section 11*d* of the toner cartridge 1 loaded in the casing of the image forming apparatus P, and also has a second opening 57, facing the photoconductor drum 61. The agitating roller 52 is located on the first opening 56 side and the developing roller 53 is located on the second opening 57 side.

The agitating roller 52 is rotationally driven by driving means (not shown), and prepares the two-component developer by agitating and mixing, in the developing tank 51, toner supplied from the toner cartridge 1 and carrier made of iron powder and the like.

The developing roller 53 facing the photoconductor drum 61 through the second opening 57 of the developing tank 51 is located separate from the photoconductor drum 61 with leaving a space therebetween, and is rotationally driven by driving means (not shown), thereby supplying the two-component developer stored in the developing tank 51 to the photoconductor drum 61.

The two-component developer is attached to the surface of the developing roller 53 by the action of a magnet (not shown) incorporated in the developing roller 53, and forms a magnetic brush.

To restrict the layer thickness of the magnetic brush formed on the surface of the developing roller 53 to a predetermined thickness, the restrictive member 54 is provided on the upper edge of the second opening 57, in proximity to the outer circumferential surface of the developing roller 53, leaving a slight space therebetween. As the material of the restrictive member 54, stainless steel may be used, but aluminum, synthetic resin, or the like may also be used.

To the developing roller 53, a developing bias voltage is applied by a power supply (not shown), and the toner contained in the magnetic brush is charged with a predetermined polarity. The magnetic brush formed on the surface of the developing roller 53 contacts the photoconductor drum 61 at the closest position to each other. This contact area is a developing nip section. In the developing nip section, the charged toner is attached, in a flying manner by electrostatic force, to the electrostatic latent image formed on the surface of the photoconductor drum 61, whereby the electrostatic latent image is made visible.

The toner concentration detecting sensor 55 is mounted in the bottom surface of the developing tank 51 and vertically below the agitating roller 52 in such a manner that a sensing surface is exposed to the inside of the developing tank 51. The toner concentration detecting sensor 55 is electrically connected to the control section 72 (see FIG. 2).

The control section 72 monitors the toner concentration in the developing tank 51 by the toner concentration detecting sensor 55, and if the toner concentration falls below a reference value, the control section 72 rotationally drives and controls a toner agitating plate 21*b* and a toner discharging roller 22*b* of the toner cartridge 1 to supply toner to the developing tank 51 through the toner discharging port 13.

The toner concentration detecting sensor 55 is not particularly specified, and for example, a transmitted light detecting sensor, a reflected light detecting sensor, or a magnetic permeability detecting sensor may be used as the toner concentration detecting sensor 55. The magnetic permeability detecting sensor is suitably used in the present embodiment.

To the toner concentration detecting sensor 55, a power supply (not shown) is connected. This power supply applies, to the toner concentration detecting sensor 55, a driving voltage for driving the toner concentration detecting sensor 55 and a control voltage for outputting the detection result of the toner concentration to the control section 72.

The application of the voltages to the toner concentration detecting sensor 55 is controlled by the control section 72. The magnetic permeability detecting sensor, used as the toner concentration detecting sensor 55 in the present embodiment, is a sensor for receiving the application of the control voltage and outputting the detection result of the toner concentration as an output voltage value, and since, basically, the output voltage is highly sensitive around the median, the sensor is used, applying such a control voltage that the output voltage around the median can be obtained. The magnetic permeability detecting sensor may be, for example, commercially available under trade names such as "TS-L", "TS-A", and "TS-K", all manufactured by TDK Corporation.

The toner cartridge 1 is constructed so as to be detachable from the image forming section 80 (see FIG. 1) to supply the toner to the developing device 50.

As shown in FIGS. 3 and 4, the toner cartridge 1 includes a container body 11 for storing toner and the toner discharging port 13 formed in a portion of the container body 11. The toner cartridge 1 has an appearance of an approximately rectangular parallelepiped, of which the bottom section is rounded.

The container body 11 is mainly constructed of a flat left wall 11*a*, a flat right wall 11*b*, a main body constructing wall 11A which has a bottom wall 11*c* connected to the left wall 11*a* and the right wall 11*b* in a rounded manner, and extends in the longitudinal direction of the container body 11, a front wall 11B and a rear wall 11C which enclose the front and the rear of the main body constructing wall 11A, respectively, a protruding wall 11*d* which protrudes from the upper end of the right wall 11*b* to the outer side of the right wall 11*b* and in which the toner discharging port 13 is formed, and a top wall 11*e*.

The main body constructing wail 11A, the front wall 11B, and the rear wall 11C are integrally molded of a resin material. On the other hand, the protruding wall 11*d* and the top wall 11*e* are molded, separately from each other, of a resin material.

The protruding wall 11*d* is joined by conventional epoxy adhesive not having electro-releasability to the upper end of the right wall 11*b* and to the peripheral edges of the front wall 11B and the rear wall 11C, and after the container body 11 is filled with toner, the top wall 11*e* is also joined by the conventional epoxy adhesive to an upper edge formed by the left wall 11*a*, the front wall 11B, the rear wall 11C, and the protruding wall 11*d*.

As the resin materials, for example, ABS (acrylonitrile-butadiene-styrene) resin, PS (polystyrene) resin, or PC (polycarbonate) resin may be used. The ABS resin, which has high impact strength, high stain resistance, and the like, and which is applicable to a wide variety of molding techniques such as injection molding, extrusion molding, and blow molding, is most favorable.

Note that the specific volume resistance (volume resistivity) of these resin materials is generally high, which is more than $10^{12}\Omega\cdot$cm.

Accordingly, in the present embodiment, while the main body constructing wall 11A, the front wall 11B, the rear wall 11C, and the top wall 11*e* are integrally molded of the ABS resin, the protruding wall 11*d* is molded of an electrically conductive resin material obtained by dispersion-mixing the above-described resin material with an electrically conductive material, since the protruding wall 11*d* is the portion in which the toner discharging port 13 is formed, and therefore is required to have electrical conductivity as described below.

The electrically conductive material is not particularly specified, and for example, carbon black, metal powder (e.g., aluminum, titanium oxide), or a mixture of these materials may be used as the electrically conductive material. The carbon black is most favorable as the electrically conductive material, since, added in even small amounts, it decreases the resistance of the resin material and does not decrease the strength of the molded material.

When the carbon black is used as the electrically conductive material, it is favorable that the carbon black is obtained by dispersion-mixing, with the resin material, the particles of the carbon black having an average primary particle size of approximately 10 to 500 nm in the range from 5 mass percent to 20 mass percent. There is a tendency that if the additive amount of the carbon black is less than 5 mass percent, electrical conductivity is difficult to obtain, and if more than 20 mass percent, the strength of the molded material decreases.

The protruding wall 11*d* has an inclined wall section between the upper and lower ends thereof, and in a portion of the inclined wall section, the rectangular toner discharging port 13 is formed. The toner discharging port 13 is formed in such a position that it faces the first opening 56 of the developing device 50 when the toner cartridge 1 is loaded into the image forming section 80 (see FIG. 1).

The top wall 11*e* is bonded to the container body 11, thereby sealing the container body 11 to prevent the toner from leaking from the container body 11.

As shown in FIG. 3, the container body 11 includes a toner lifting mechanism 21 and a toner discharging mechanism 22.

The toner lifting mechanism 21 includes a stainless-steel rotary shaft 21*a* rotatably and pivotally supported by the front wall 11B and the rear wall 11C of the toner cartridge 1 across the approximate center of the container body 11, the rectangular and perforated toner agitating plate (agitating member) 21*b* fixed to the rotary shaft 21*a*, and a pair of rectangular toner lifting blades 21*c* attached along the both ends of and in the width direction of the toner agitating plate 21*b*. The toner lifting blades 21*c* have flexibility, and may each be a plastic sheet, approximately 0.5 to 2 mm thick and made of, for example, polyethylene terephthalate (PET) or polypropylene.

The toner discharging mechanism 22 includes a stainless-steel rotary shaft 22*a* rotatably and pivotally supported by the front wall 11B and the rear wall 11C across the space defined by the protruding wall 11*d*, and the toner discharging roller 22*b* fixed to the rotary shaft 22*a*.

The toner discharging roller 22*b*, formed by wrapping a porous elastic medium made of foamed ester polyurethane foam (i.e., sponge-like) around the rotary shaft 22*a*, seals the toner discharging port 13 from within by elastically contacting the toner discharging port 13, and also discharges toner from the toner discharging port 13 by rotating in accordance with the rotation of the rotary shaft 22*a*.

The toner discharging roller 22*b* is formed of the foamed elastic medium having elasticity, whereby it is possible to effectively discharge the toner when the toner cartridge 1 is loaded into the image forming section 80.

As the material of the foamed elastic medium, for example, polyurethane, silicone rubber, or EPDM may be used. The polyurethane foam is suitable in view of durability and toner discharging performance.

The toner agitating plate 21*b* agitates the toner stored in the toner cartridge 1 by rotating around the rotary shaft 21*a* in the direction of an arrow A, and simultaneously, the toner lifting blades 21*c* lift the toner within the toner cartridge 1 and supply the lifted toner to the toner discharging roller 22*b*. The toner discharging roller 22*b* supplies the toner, lifted to the protruding wall 11*d* by the toner lifting blades 21*c*, to the developing tank 51 of the developing device 50 through the toner discharging port 13 by counter-rotating in the direction of an arrow B.

Note that the rotary shaft 21*a* that rotates the toner agitating plate 21*b* and the rotary shaft 22*a* that rotates the toner discharging roller 22*b* are constructed to synchronously rotate counter to each other by a gear transmission mechanism (not shown), provided outside the rear wall 11C of the toner cartridge 1, and also by driving force transmitted from a driving motor provided in the image forming section 80 having the toner cartridge 1 loaded thereinto. Further, the driving motor is driven to rotate the toner discharging roller 22*b* and the toner agitating plate 21*b*, under the control of the control section 72 (see FIG. 2), provided in the image forming apparatus P.

Figure 5:
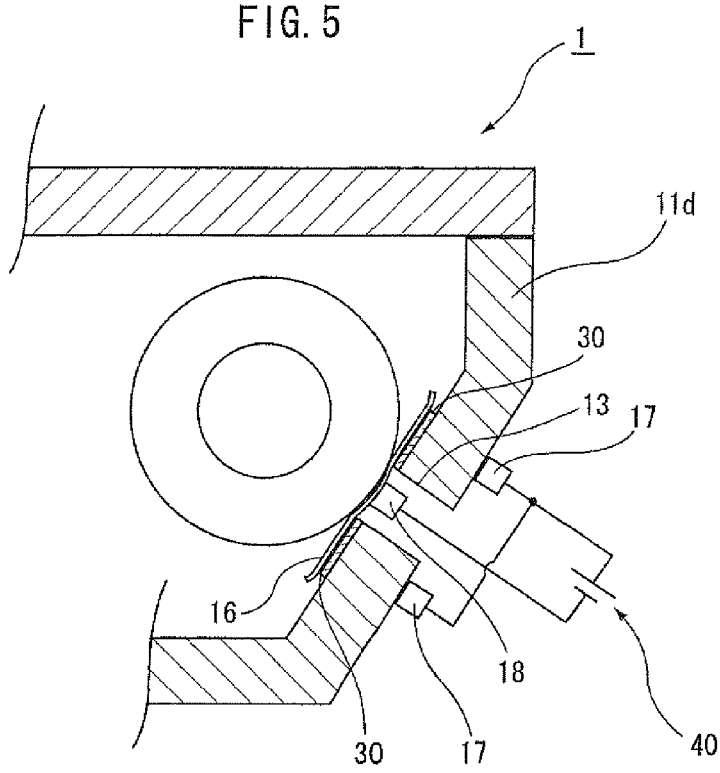
FIG. 5 is an enlarged view of the principal part of FIG. 3.

FIG. 5 is an enlarged view of the principal part of FIG. 3, showing the state immediately after an unused toner cartridge 1 is loaded into the image forming section 80 (see FIG. 1). Additionally, FIG. 6 is a partially cut-away perspective view of the principal part of FIG. 5.

Figure 6:
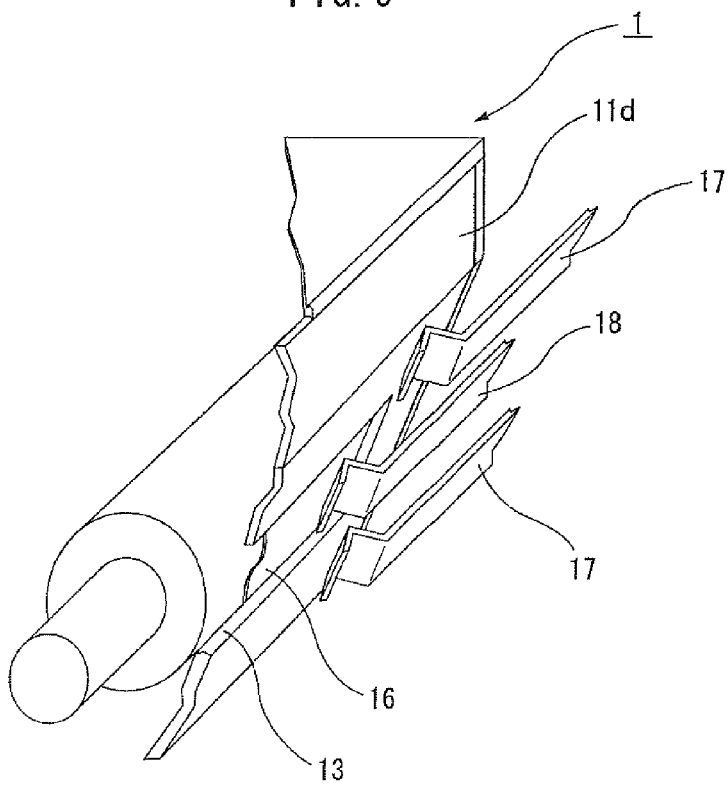
FIG. 6 is a partially cut-away perspective view of the principal part of FIG. 5.

As shown in FIGS. 5 and 6, in the unused toner cartridge 1, the toner discharging port 13 is sealed by a seal member 16 so as to prevent the toner from leaking during transport from the factory or during storage. The seal member 16 is bonded by electro-releasing adhesive 30 to the inner peripheral edge of the toner discharging port 13 and thus provided between the toner discharging roller 22*b* and the toner discharging port 13.

Note that FIG. 3, referred to in the above description, shows the state where the seal member 16 has already been released from the toner discharging port 13, and therefore does not show the released seal member.

The seal member 16 is a flexible film member or a flexible sheeted member, each made of polypropylene, nylon, polyethylene, metal, or the like.

It is favorable that in the seal member 16, at least the portion contacting the peripheral edge of the toner discharging port 13 and the portion exposed to the outside of the toner discharging port 13 through the toner discharging port 13 (hereinafter, these portions each will be referred to as an "electrical conductivity required section") have electrical conductivity.

Accordingly, when the seal member 16 is made of the above-described resin material, a sheet formed of the resin material is used as a base sheet. A flexible metal sheet made of aluminum or the like is bonded to at least the electrical conductivity required section of this base sheet in a laminated manner, or an electrically conductive resin layer made of polyaniline or the like is laminated on the base sheet, whereby electrical conductivity is provided thereto.

In the seal member 16, the surface having electrical conductivity, of the electrical conductivity required section, faces and is bonded by the electro-releasing adhesive 30 to the inner peripheral edge of the toner discharging port 13.

Consequently, the seal member 16 having electrical conductivity is bonded by the electro-releasing adhesive 30 to the peripheral edge of the toner discharging port 13 of the protruding wall 11*d* having electrical conductivity.

Note that as the electro-releasing adhesive 30, for example, a product manufactured by a method disclosed in Japanese Unexamined Patent Publication No. 2003-504504, or a commercial item may be used. The commercial item of the electro-releasing adhesive 30 may be, for example, commercially available under a trade name such as "ElectRelease (epoxy adhesive)" manufactured by EIC Laboratories, Inc.

The electro-releasing adhesive 30 has a function capable of causing a bond release at a positive interface between the electro-releasing adhesive 30 and an adherend electrically connected to an anode, or a function capable of causing a bond release at a negative interface between the electro-releasing adhesive 30 and an adherend electrically connected to a cathode.

In the present embodiment, for the reason described below, the electro-releasing adhesive 30 having the function capable of causing a bond release at a positive interface between the electro-releasing adhesive 30 and an adherend electrically connected to an anode, is used.

The electro-releasing adhesive 30 that bonds the seal member 16 to the peripheral edge of the toner discharging port 13, may have such a thickness that it is possible to secure adhesive force sufficient not to break a joint by external forces such as impact during transport and that the electro-releasing adhesive does not protrude from the joined section, and for example, an appropriate thickness is approximately 200 to 500 μm.

As shown in FIGS. 5 and 6, the image forming section 80 (see FIG. 1) includes a first electrode 17 and a second electrode 18 that contact the protruding wall 11*d* having electrical conductivity, of the toner cartridge 1, and the surface having electrical conductivity, of the seal member 16, respectively, when the toner cartridge 1 is loaded into the image forming section 80.

As shown in FIG. 5, the first and second electrodes 17 and 18 are connected to a DC power supply 40, and selectively controlled by the control section 72 (see FIG. 2) to have a voltage applied or to have no voltage applied, and the first electrode 17 is an anode and the second electrode 18 is a cathode.

As shown in FIG. 6, the first and second electrodes 17 and 18 are elongated flat plates, each of which extends in the longitudinal direction of the toner cartridge 1 and is made of metallic material such as phosphor bronze so as to have elasticity, and an end of each plate is bent in such an angular manner that the first and second electrodes 17 and 18 smoothly contact the protruding wall 11*d* and the seal member 16 of the toner cartridge 1, respectively, when the toner cartridge 1 is loaded into the image forming section 80.

Here, with reference to FIG. 7, the control flow of the control section 72 (see FIG. 2) when the toner cartridge 1 is replaced will be described, and additionally, with reference to FIGS. 8 and 9, the action of the seal member 16 when automatically released from the toner discharging port 13 will be described.

Figure 7:
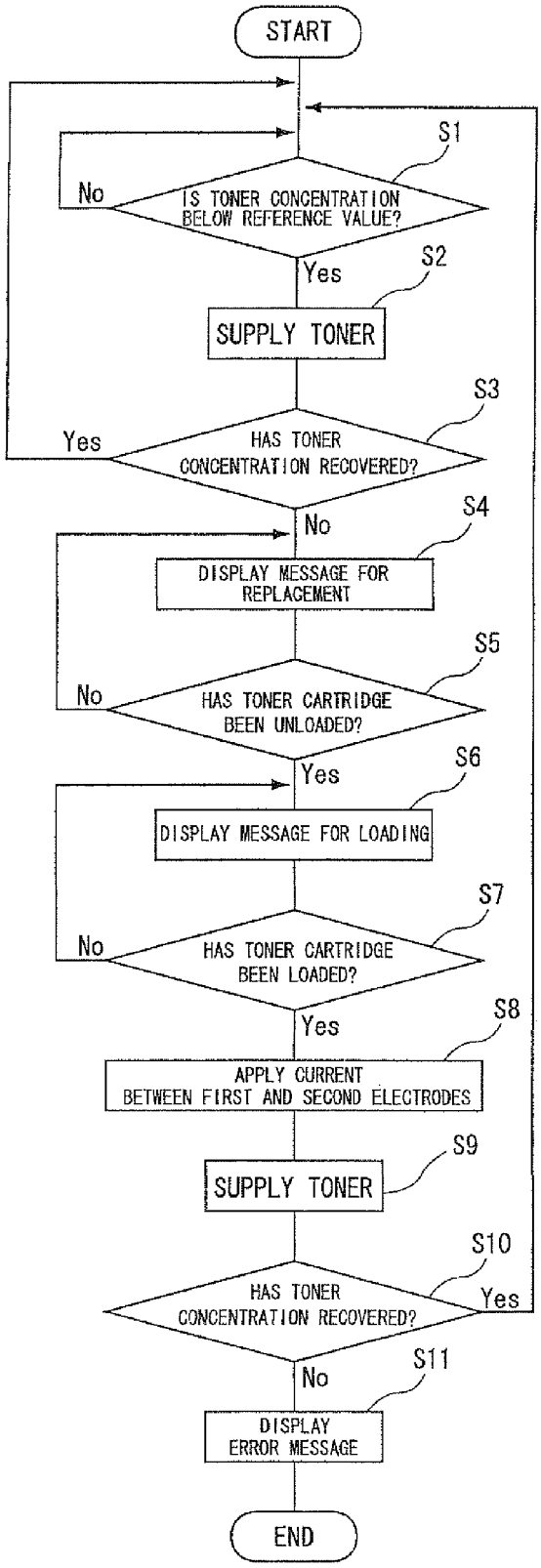
FIG. 7 is a flow chart showing the sequential control flow of the control section when the toner cartridge is replaced in the image forming apparatus according to the embodiment 1.
Figure 8:
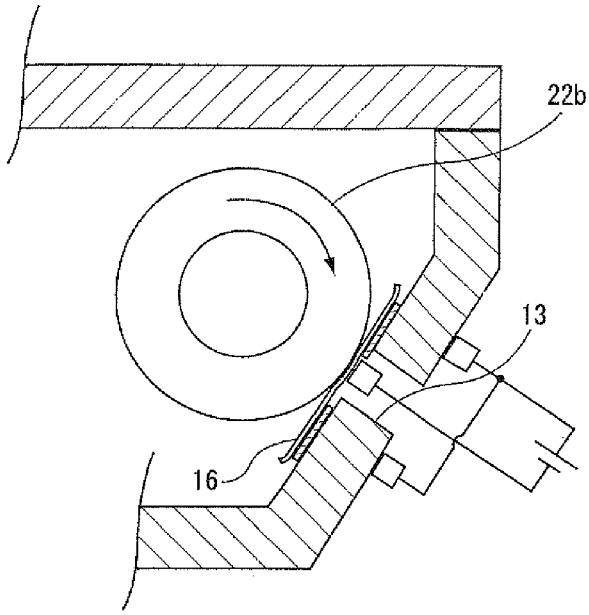
FIG. 8 is a diagram illustrating the action of a seal member when the seal member is released from a toner discharging port in the image forming apparatus according to the embodiment 1.
Figure 9:
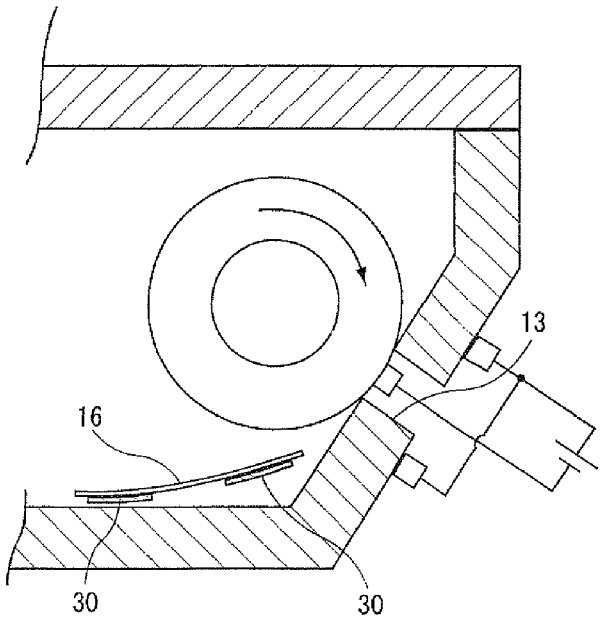
FIG. 9 is a diagram illustrating the action of the seal member when the seal member is released from the toner discharging port in the image forming apparatus according to the embodiment 1.

FIG. 7 is a flow chart showing the sequential control flow of the control section 72 when the toner cartridge 1 is replaced, and FIGS. 8 and 9 are diagrams illustrating the action of the seal member 16 when the seal member 16 is released from the toner discharging port 13.

Note that for the structure of each element referred to in the description below, FIGS. 3 through 6 will be referred back to, appropriately.

As described above, the control section 72 monitors the toner concentration in the developing tank 51 of the developing device 50, and when determining that the toner concentration has fallen below a reference value, the control section 72 drives the toner lifting mechanism 21 and the toner discharging mechanism 22 of the toner cartridge 1 to supply toner to the developing tank 51 from the toner cartridge 1 (step 1, step 2).

Next, the control section 72 determines whether or not the toner concentration has recovered to the reference value (step 3), and when determining that the toner concentration has recovered to more than the reference value, the control section 72 continues to monitor the toner concentration, returning to step 1.

On the other hand, when determining in step 3 that the toner concentration has not recovered to more than the reference value, the control section 72 determines that the toner in the toner cartridge 1 has been depleted, and displays a message, for urging the user to replace the toner cartridge 1, in a display section (not shown) of the image forming apparatus P (step 4).

Next, the control section 72 determines whether or not the toner cartridge 1 has been unloaded from the image forming section 80 (step 5), and when determining that the toner cartridge 1 has been unloaded, the control section 72 displays a message, for urging the user to load a new toner cartridge 1, in the display section (not shown) (step 6).

Next, the control section 72 determines whether or not the toner cartridge 1 has been loaded into the image forming section 80, and when determining that the toner cartridge 1 has been loaded, the control section 72 determines that the toner cartridge 1 has been replaced with an unused new toner cartridge 1 (step 7).

On the other hand, when determining in step 7 that the toner cartridge 1 has not been loaded, the control section 72 continues to display the message for urging the user to load a new toner cartridge 1, returning to step 6.

When determining in step 7 that the unused new toner cartridge 1 has been loaded into the image forming section 80, the control section 72 controls the DC power supply 40, connected to the first and second electrodes 17 and 18, to apply a direct current between the first and second electrodes 17 and 18 via the electro-releasing adhesive 30 at a predetermined voltage for a predetermined time (step 8).

When the direct current is applied between the first and second electrodes 17 and 18 at the predetermined voltage for the predetermined time in step 8, the control section 72 drives the toner lifting mechanism 21 and the toner discharging mechanism 22 to supply toner to the developing tank 51 of the developing device 50 from the loaded new toner cartridge 1 (step 9).

At this time, in the electro-releasing adhesive 30, adhesive force has been decreased due to a bond release reaction caused by the application of the direct current between the first and second electrodes 17 and 18 in the above step 8.

As a result, when the toner lifting mechanism 21 and the toner discharging mechanism 22 are driven in step 9, as shown in FIG. 8, the toner discharging roller 22*b* rubs the seal member 16, of which the adhesive force to the peripheral edge of the toner discharging port 13 has been decreased, and as shown in FIG. 9, the seal member 16 is automatically peeled from the toner discharging port 13.

As described above, the electro-releasing adhesive 30 used in the present embodiment has a character that, when a current is applied to the electro-releasing adhesive 30, a bond release reaction is caused at the joined surface of the electro-releasing adhesive 30 and an adherend electrically connected to an anode.

As a result, the electro-releasing adhesive 30 causes a bond release reaction at the joined surface of the electro-releasing adhesive 30 and the peripheral edge of the toner discharging port 13 contacting the first electrode (an anode) 17, and peels from the toner discharging port 13, remaining attached to the seal member 16 and not remaining on the peripheral edge of the toner discharging port 13 as shown in FIG. 9.

Thus, it is possible to prevent the toner accumulated and solidified on the peripheral edge of the toner discharging port 13 from disturbing the supply of toner.

Next, the control section 72 determines whether or not the toner concentration in the developing tank 51 has recovered to more than the reference value (step 10).

When determining in step 10 that the toner concentration in the developing tank 51 has recovered to more than the reference value, the control section 72 continues to monitor the toner concentration, returning to step 1.

On the other hand, when determining that the toner concentration has not recovered to more than the reference value, the control section 72 determines that some problem has occurred, e.g., the toner cartridge 1 loaded in the above step 7 is empty, or the toner cartridge 1 is not properly loaded. Then, the control section 72 displays an error message for urging the user to confirm the toner cartridge 1 (step 11), and the sequential flow ends.

Note that when the current is applied between the first and second electrodes 17 and 18 in step 8, an applied voltage and an application time are required to be sufficient to cause a bond release reaction in the electro-releasing adhesive 30.

Since the current required to cause a bond release reaction in the electro-releasing adhesive 30 is approximately 3 to 10 amperes per square centimeter, it is sufficient for the current application that a voltage of several volts to several tens of volts is applied. However, when the toner cartridge 1, particularly the peripheral edge of the toner discharging port 13 contacting the first electrode 17 and the seal member 16 contacting the second electrode 18, does not have electrical conductivity and therefore specific volume resistance (the resistance around the joined section in particular) is high, a voltage of approximately several hundred volts is required.

In view of the safety of a current application process, damage prevention for the container body 11, and the like, it is favorable that the applied voltage is as low as possible, and in view of workability, it is favorable that the application time is as short as possible.

Therefore, in the present embodiment, the protruding wall 11*d*, in which the toner discharging port 13 is formed and which contacts the first electrode 17, is molded of the electrically conductive resin material, whereby electrical conductivity is provided thereto, and at the same time, electrical conductivity is also provided to the seal member 16 contacting the second electrode 18, whereby the applied voltage and the application time are reduced.

In the present embodiment, in view of workability, safety, damage prevention for the toner cartridge 1, and the like, a voltage of 80 volts is applied between the first and second electrodes 17 and 18 for 3 minutes, and a direct current of approximately 3 to 10 $A/cm^2$ is applied to the electro-releasing adhesive 30, whereby the bond release reaction is caused at the joined surface of the electro-releasing adhesive 30 and the adherend electrically connected to the first electrode 17, i.e., at the interface of the electro-releasing adhesive 30 and the peripheral edge of the toner discharging port 13, whereby the adhesive force of the seal member 16 to the peripheral edge of the toner discharging port 13 decreases.

Embodiment 2

Figure 10:
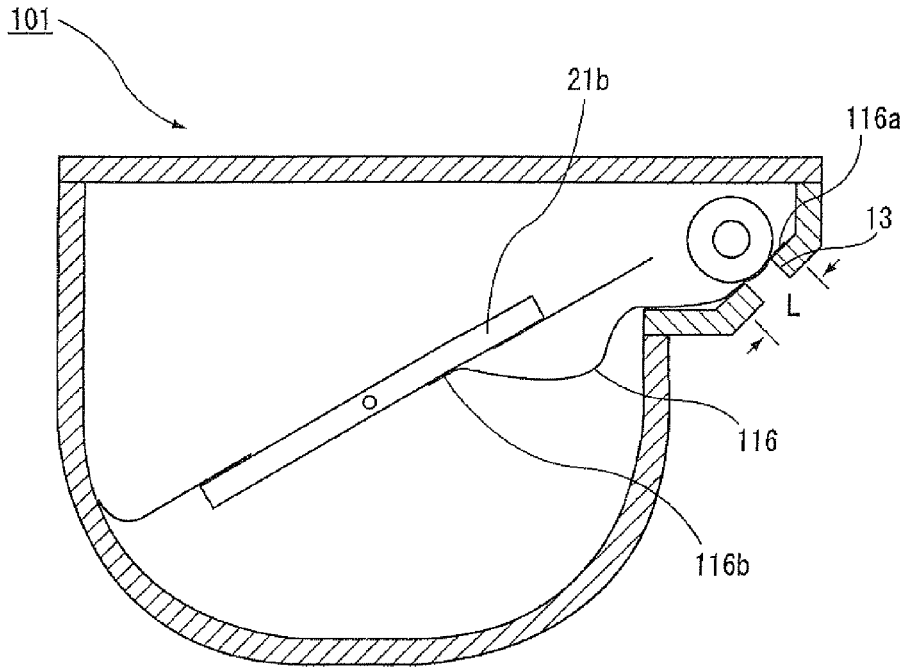
FIG. 10 is a diagram illustrating a toner cartridge immediately after being loaded into an image forming apparatus according to an embodiment 2 of the present invention.
Figure 11:
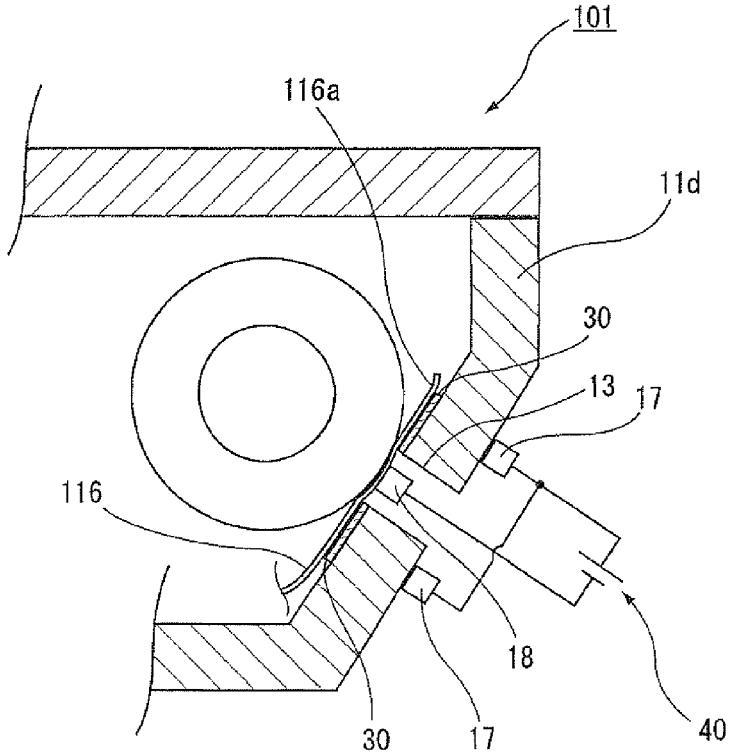
FIG. 11 is an enlarged view of the principal part of FIG. 10.
Figure 12:
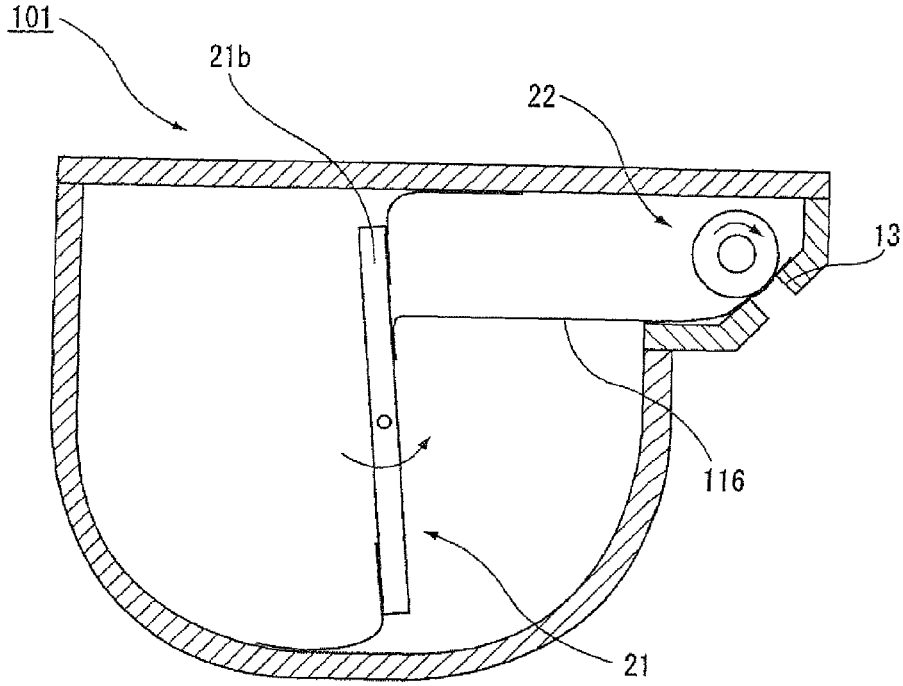
FIG. 12 is a diagram illustrating the action of a seal member when the seal member is released from a toner discharging port of the image forming apparatus according to the embodiment 2.
Figure 13:
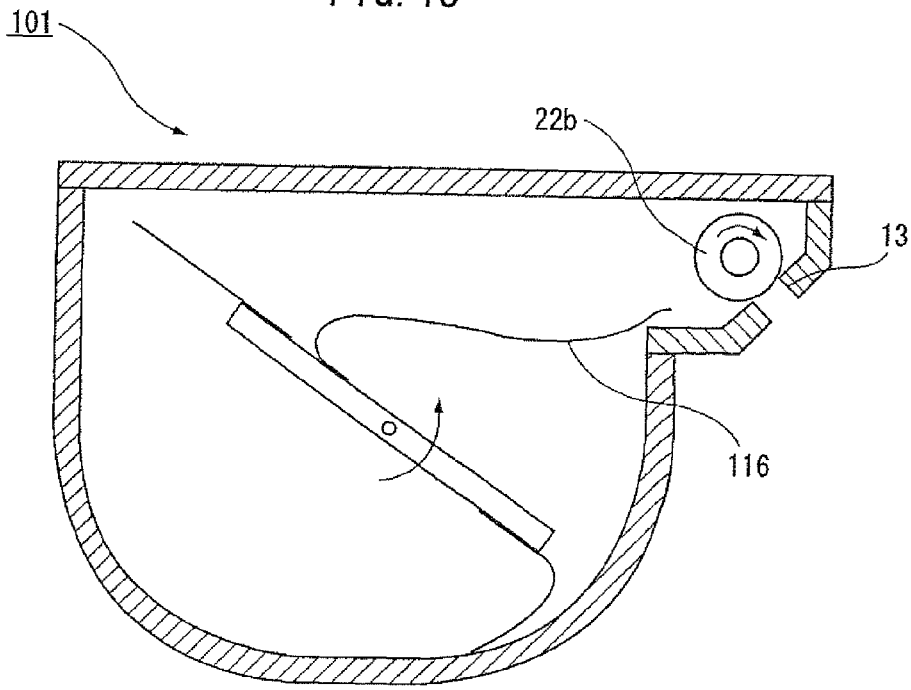
FIG. 13 is a diagram illustrating the action of the seal member when the seal member is released from the toner discharging port in the image forming apparatus according to the embodiment 2.

With reference to FIGS. 10 through 13, an image forming apparatus according to an embodiment 2 of the present invention will be described. FIG. 10 is a diagram illustrating a toner cartridge immediately after being loaded into the image forming apparatus according to the embodiment 2, FIG. 11 is an enlarged view of the principal part of FIG. 10, and FIGS. 12 and 13 are diagrams illustrating the action of a seal member when released from a toner discharging port of the image forming apparatus according to the embodiment 2.

As shown in FIGS. 10 and 11, in a toner cartridge 101 loaded into the image forming apparatus (not shown) according to the embodiment 2, a seal member 116 is longer than a minimum length L required to seal the toner discharging port 13. One end 116*a* of the seal member 116 is an electrical conductivity required section, and the surface having electrical conductivity, of the electrical conductivity required section, faces and is bonded by the electro-releasing adhesive 30 to the inner peripheral edge of the toner discharging port 13, while an other end 116*b* is joined by conventional epoxy adhesive not having electro-releasability to the portion that becomes the back of the toner agitating plate (agitating member) 21*b* when the toner agitating plate 21*b* rotates.

The other elements are similar to those of the toner cartridge 1 (see FIGS. 3 through 6) loaded into the image forming apparatus P (see FIG. 1) according to the embodiment 1.

Note that in the present embodiment, in the seal member 116, at least only the one end 116*a*, contacting the peripheral edge of the toner discharging port 13 and exposed to the outside of the toner discharging port 13, is the electrical conductivity required section, while the other end 116*b*, joined to the back of the toner agitating plate 21*b*, does not have electrical conductivity. Needless to say, however, the whole area of the seal member 116 may have electrical conductivity.

It may be determined, taking the cost of manufacturing the seal member 116 and the like into account, whether electrical conductivity is selectively provided to the one end 116*a*, sealing the toner discharging port 13, of the seal member 116 or is provided to the whole area of the seal member 116.

In the image forming apparatus according to the embodiment 2, due to the above-described structure of the toner cartridge 101, when the toner cartridge 101 is replaced and the control section 72 (see FIG. 2) controls the DC power supply 40 to apply a direct current between the first and second electrodes 17 and 18 via the electro-releasing adhesive 30 at a predetermined voltage for a predetermined time, similarly to the embodiment 1, a bond release reaction is caused at the joined surface of the electro-releasing adhesive 30 and the protruding wall 11*d* contacting an anode, whereby the adhesive force of the seal member 116 to the peripheral edge of the toner discharging port 13 decreases.

Subsequently, when the toner lifting mechanism 21 and the toner discharging mechanism 22 are driven under the control of the control section 72 to supply toner, as shown in FIG. 12, the seal member 116, of which the adhesive force to the peripheral edge of the toner discharging port 13 has been decreased, is pulled by the rotating toner agitating plate 21*b*, and as shown in FIG. 13, the seal member 116 is smoothly and certainly pulled out from between the toner discharging roller 22*b* and the toner discharging port 13 (i.e., automatically peeled from the toner discharging port 13).

Note that as described above, since the electro-releasing adhesive 30 causes the bond release reaction at the joined surface of the electro-releasing adhesive 30 and the protruding wall 11*d* contacting the anode when the current is applied between the first and second electrodes 17 and 18, similarly to the embodiment 1, the electro-releasing adhesive 30 peels, remaining attached to the seal member 116 and not remaining on the peripheral edge of the toner discharging port 13.

Thus, similarly to the embodiment 1, it is possible to prevent the toner accumulated and solidified on the peripheral edge of the toner discharging port 13 from disturbing the supply of toner.

Further, in the embodiment 2, as described above, the other end 116*b* of the seal member 116 is joined to the back of the toner agitating plate 21*b* that rotates in the toner cartridge 101, and therefore the seal member 116 is forcibly pulled and peeled by the toner agitating plate 21*b* rotating at the time of supplying toner. Therefore, this structure is more favorable in view of guaranteeing certainty of release of the seal member 116.

Embodiment 3

Figure 14:
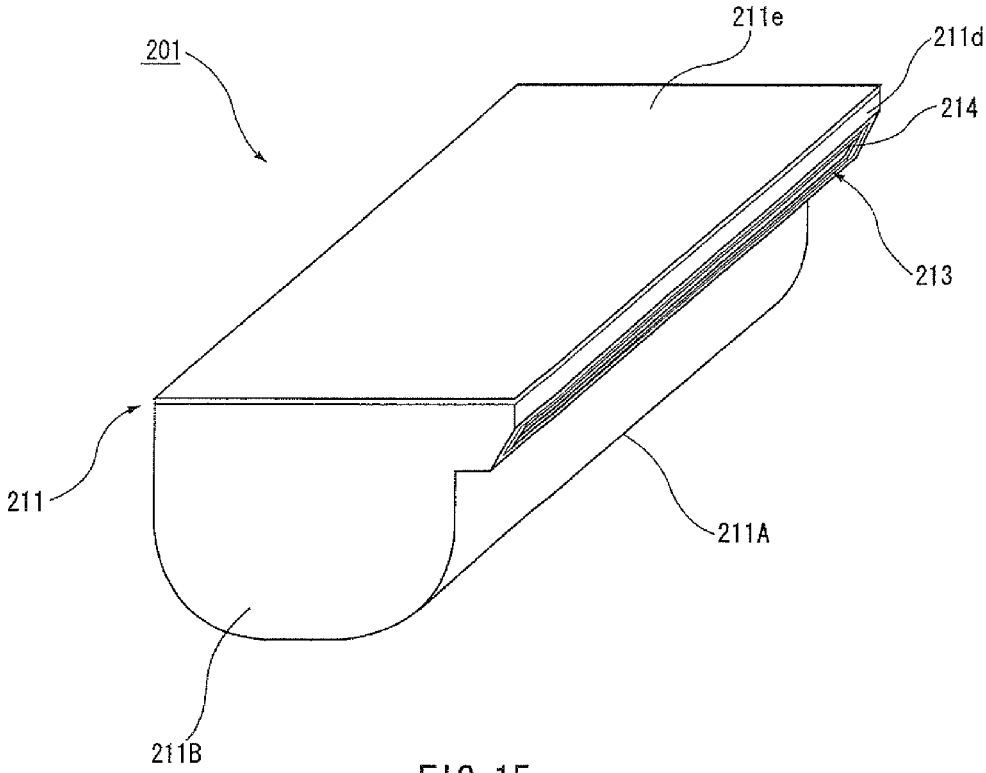
FIG. 14 is a perspective view of a toner cartridge to be loaded into an image forming apparatus according to an embodiment 3 of the present invention.
Figure 15:
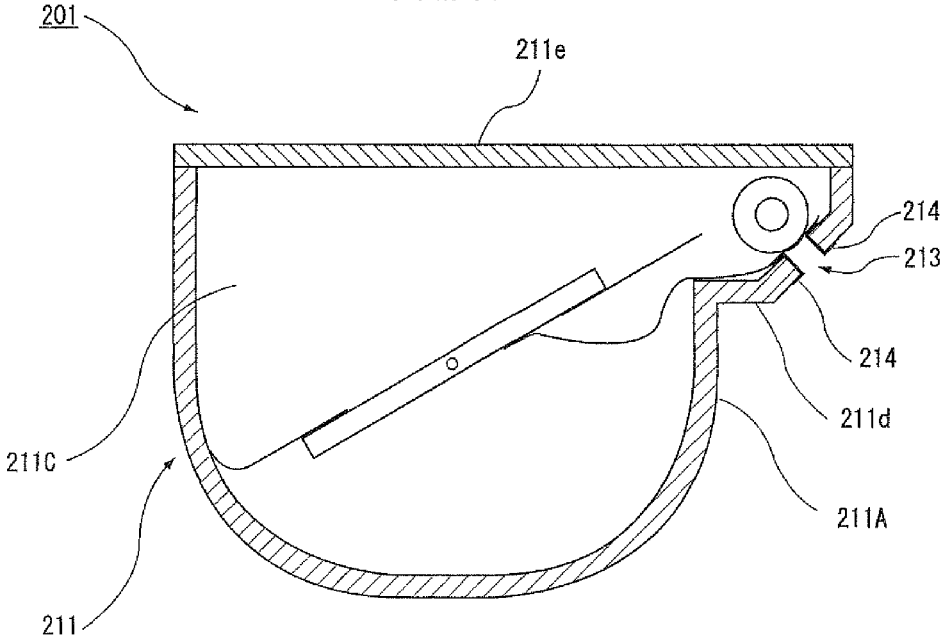
FIG. 15 is a cross-sectional view of the toner cartridge shown in FIG. 14.
Figure 16:
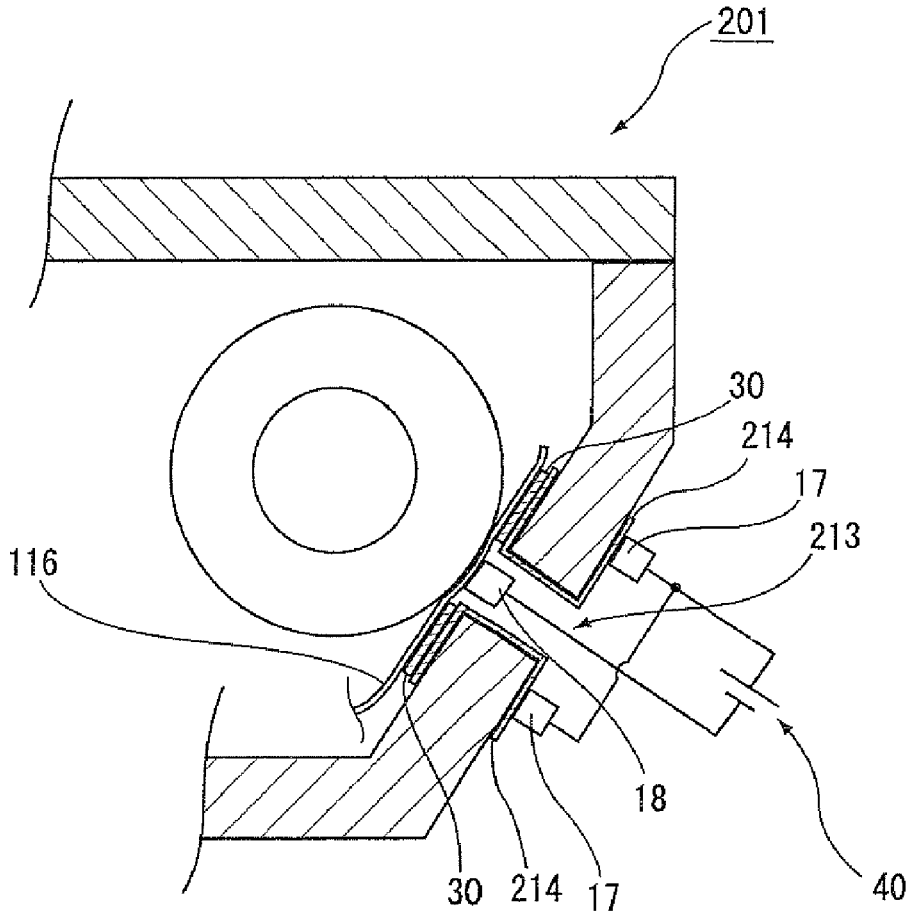
FIG. 16 is an enlarged view of the principal part of FIG. 15.

With reference to FIGS. 14 through 16, an image forming apparatus according to an embodiment 3 of the present invention will be described. FIG. 14 is a perspective view of a toner cartridge loaded into the image forming apparatus according to the embodiment 3, FIG. 15 is a cross-sectional view of the toner cartridge shown in FIG. 14, and FIG. 16 is an enlarged view of the principal part of FIG. 15.

As shown in FIGS. 14 and 15, in a toner cartridge 201 of the image forming apparatus (not shown) according to the embodiment 3, a protruding wall 211*d*, a main body constructing wall 211A, a front wall 211B, and a rear wall 211C are integrally molded of the ABS resin.

Thus, a metal plate 214, bent to have a U-shaped cross section, is provided so as to cover the peripheral edge of a toner discharging port 213, whereby electrical conductivity is provided to the toner discharging port 213.

As shown in FIG. 16, the metal plate 214 is joined by conventional epoxy adhesive not having electro-releasability to the peripheral edge of the toner discharging port 213, and the seal member 116 is bonded by the electro-releasing adhesive 30 to the metal plate 214 that covers the peripheral edge of the toner discharging port 213.

Note that the material of the metal plate 214 is not particularly specified so long as it has electrical conductivity, and for example, aluminum or SUS (stainless steel) may be used as the material of the metal plate 214. The SUS is most favorable in view of strength and corrosion resistance. An appropriate thickness of the metal plate 214 is approximately 100 to 300 μm, and it is favorable that the portion covering the peripheral edge of the toner discharging port 213 has a width sufficient to secure the contact points between the metal plate 214 and the first and second electrodes 17 and 18, e.g., a width of approximately 1 to 5 mm.

The other elements are similar to those of the toner cartridge 101 (see FIG. 10) loaded into the image forming apparatus according to the embodiment 2.

In the image forming apparatus according to the embodiment 3, due to the above-described structure of the toner cartridge 201, all parts except for a top wall 211*e* can be integrally molded.

Consequently, it is possible to save the trouble of, as in the embodiments 1 and 2, separately molding the protruding wall 11*d* (see FIGS. 3 and 4) of the electrically conductive resin material and joining the molded protruding wall 11*d* by conventional epoxy adhesive not having electro-releasability to the upper edge of the right wall 11*b* and to the peripheral edges of the front wall 11B and the rear wall 11C, and thus it is possible to manufacture a container body 211 more easily.

Further, since the toner discharging port 213 is provided with electrical conductivity by the metal plate 214 covering the peripheral edge of the toner discharging port 213, electrical resistance is lower in the toner discharging port 213 than in the toner discharging ports of the embodiments 1 and 2. As a result, a lower applied voltage can be applied by the DC power supply 40 for a shorter application time when a current is applied between the first and second electrodes 17 and 18, and thus the safety of a current application process is more improved.

In the embodiment 3, for example, a voltage of 50 volts is applied by the DC power supply 40 for 2 minutes, whereby it is possible to apply a direct current of approximately 3 to 10 $A/cm^2$, which is required to cause a bond release reaction in the electro-releasing adhesive 30.

As described in detail above, based on the image forming apparatus according to the present invention, a current is applied to electro-releasing adhesive via first and second electrodes when a toner cartridge is loaded into the image forming apparatus, whereby the adhesive force of the electro-releasing adhesive decreases, whereby a seal member can be automatically released from a toner discharging port.

Thus, even an inexperienced user can easily replace the toner cartridge, and therefore it is possible to reduce downtime (inoperable time) of the image forming apparatus.

Note that as examples of the image forming apparatus according to the present invention, three embodiments are described above, but the present invention is not limited to these three embodiments, and numerous other modifications and variations can be devised without departing from the scope of the invention.

For example, in the embodiments 1 and 2, only the protruding wall 11*d* is molded of the electrically conductive resin material, whereby electrical conductivity is provided to the toner discharging port 13, but the whole of the container body 11 except for the top wall 11*e* may be integrally molded of the electrically conductive resin material.

Further, in the embodiments 2 and 3, the toner agitating plate 21*b* functions as a release system for releasing the seal member 116, but, needless to say, as in the embodiment 1, the toner discharging roller 22*b* may function as the release system, and numerous other modifications, variations, and combinations can be devised.

What is claimed is:

1. An image forming apparatus comprising: an image forming section for forming an image; and a toner cartridge for supplying a toner to the image forming section, the toner cartridge being detachably loaded into the image forming section;

the toner cartridge including a toner discharging port for discharging the toner when the toner cartridge is loaded into the image forming section, and a seal member for sealing the toner discharging port until the toner cartridge is loaded into the image forming section, the seal member being bonded to a peripheral edge of the toner discharging port by electro-releasing adhesive, of which adhesive force decreases when a current is applied thereto;

the image forming section including a first electrode and a second electrode that contact the peripheral edge of the toner discharging port and the seal member, respectively, when the toner cartridge is loaded into the image forming section, and a power supply for applying a voltage between the first and second electrodes;

wherein, when a current is applied to the electro-releasing adhesive via the first and second electrodes, the adhesive force of the electro-releasing adhesive decreases, whereby the seal member is released from the toner discharging port.

2. The image forming apparatus as set forth in claim 1, wherein the toner cartridge includes a release mechanism for assisting the release of the seal member when the adhesive force of the electro-releasing adhesive has been decreased by the application of the current.

3. The image forming apparatus as set forth in claim 2, wherein the seal member is a flexible film for sealing the toner discharging port from the inside;

the toner cartridge includes a toner discharging roller for discharging the toner; and the toner discharging roller functions as the release mechanism for assisting the release of the seal member by rotating, elastically contacting the seal member from the inside of the toner cartridge.

4. The image forming apparatus as set forth in claim 2, wherein the seal member is a flexible film for sealing the toner discharging port from the inside;

the toner cartridge includes an agitating member for agitating the toner; and the agitating member functions as the release mechanism for assisting the release of the seal member by being connected to one end of the seal member in advance and pulling the seal member.

5. The image forming apparatus as set forth in claim 1, wherein the power supply is a DC power supply;

the electro-releasing adhesive has a character that, when the current is applied thereto, a bond release occurs at an interface of the electro-releasing adhesive and an adherend electrically connected to an anode; and the first electrode is an anode contacting the peripheral edge of the toner discharging port and the second electrode is a cathode contacting the seal member.

6. The image forming apparatus as set forth in claim 1, wherein the peripheral edge of the toner discharging port and the seal member each have electrical conductivity so that a current is applicable to the electro-releasing adhesive via the first and second electrodes when the toner cartridge is loaded into the image forming section.

7. The image forming apparatus as set forth in claim 6,
wherein the toner cartridge is formed so that at least the peripheral edge of the toner discharging port is molded of an electrically conductive resin material obtained by dispersion-mixing a resin material with an electrically conductive material.

8. The image forming apparatus as set forth in claim 7,
wherein the electrically conductive material is carbon black.

9. The image forming apparatus as set forth in claim 6,
wherein the toner cartridge includes a metal plate for covering the peripheral edge of the toner discharging port.

10. The image forming apparatus as set forth in claim 6,
wherein the seal member is formed by laminating a metal sheet or an electrically conductive resin layer on a base sheet.

11. A toner cartridge comprising:
a container body for storing a toner;
a toner discharging port for discharging the toner, the toner discharging port being formed in a portion of the container body; and
a seal member for sealing the toner discharging port,
the seal member being bonded to a peripheral edge of the toner discharging port by electro-releasing adhesive, of which adhesive force decreases when a current is applied thereto.

12. The toner cartridge as set forth in claim 11, further comprising a release mechanism for assisting a release of the seal member when the adhesive force of the electro-releasing adhesive has been decreased by the application of the current.

13. The toner cartridge as set forth in claim 12,
wherein the seal member is a flexible film for sealing the toner discharging port from the inside of the container body;
the container body includes a toner discharging roller for discharging the toner; and
the toner discharging roller functions as the release mechanism for assisting a release of the seal member by rotating, elastically contacting the seal member from the inside of the container body.

14. The toner cartridge as set forth in claim 12,
wherein the seal member is a flexible film for sealing the toner discharging port from the inside of the container body;
the container body includes an agitating member for agitating the toner; and
the agitating member functions as the release mechanism for assisting a release of the seal member by being connected to one end of the seal member in advance and pulling the seal member.

15. The toner cartridge as set forth in claim 11,
wherein the peripheral edge of the toner discharging port and the seal member each have electrical conductivity.

16. The toner cartridge as set forth in claim 15,
wherein the container body is formed so that at least the peripheral edge of the toner discharging port is molded of an electrically conductive resin material obtained by dispersion-mixing a resin material with an electrically conductive material.

17. The toner cartridge as set forth in claim 16,
wherein the electrically conductive material is carbon black.

18. The toner cartridge as set forth in claim 15,
wherein the container body includes a metal plate for covering the peripheral edge of the toner discharging port.

19. The toner cartridge as set forth in claim 15,
wherein the seal member is formed by laminating a metal sheet or an electrically conductive resin layer on a base sheet.

* * * * *